US005297816A

United States Patent [19]

Becchio

[11] Patent Number: 5,297,816

[45] Date of Patent: Mar. 29, 1994

[54] GYRATING MACHINE FOR AN ENTERTAINMENT GAME

[76] Inventor: Carlos A. Becchio, Brandsen 2235, Virreyes, Province of Buenos Aires, Argentina

[21] Appl. No.: 90,893

[22] Filed: Jul. 12, 1993

[30] Foreign Application Priority Data

Oct. 16, 1992 [AR] Argentina ..... 323437

[51] Int. Cl.[5] ..... A63F 9/00

[52] U.S. Cl. ..... 273/459; 273/138 A; 222/342

[58] Field of Search ..... 273/459, 460, 138 R, 273/138 A, 440, 454, 140; 222/342, 410

[56] References Cited

U.S. PATENT DOCUMENTS

| | | | |
|---|---|---|---|
| 4,653,674 | 3/1987 | Kihara et al. | 222/342 |
| 4,865,092 | 9/1989 | Reichelt | 222/342 X |
| 5,242,667 | 9/1993 | Koioi et al. | 222/342 X |

FOREIGN PATENT DOCUMENTS

| | | | |
|---|---|---|---|
| 1177535 | 9/1964 | Fed. Rep. of Germany | 273/448 |
| 2114452 | 8/1983 | United Kingdom | 273/138 R |
| 2124913 | 2/1984 | United Kingdom | 273/138 R |
| 2226766 | 7/1990 | United Kingdom | 273/140 |

*Primary Examiner*—Paul E. Shapiro
*Attorney, Agent, or Firm*—Kuhn and Muller

[57] ABSTRACT

A gyrating machine for entertainment game, of a type including a cabinet which contains in its interior the machine proper. The machine is operated by the introduction of an authorized chip, which starts the game. The machine located inside the cabinet includes a vertical gyrating axle, which supports, at different heights, sweeping elements. The sweeping elements are located respectively across from the upper surfaces of corresponding fixed discoidal platforms, supported by lateral columns. Each platform has a smaller diameter than the following lower one, whereby the first upper platform constitutes the surface which receives the chip falling towards the interior of the machine when the game starts.

5 Claims, 2 Drawing Sheets

GYRATING MACHINE FOR AN ENTERTAINMENT GAME

FIELD OF THE INVENTION

The main object of the present invention is to provide a novel gyrating machine for an entertainment game. The innovative feature of the present invention is based upon a special operating principle, for a recreational game. The novel features are specifically based on gyrating movements of sweeping elements, which sweeping elements move disc-shaped playing chips from one upper playing surface to subsequent lower playing surfaces.

More precisely, the present invention concerns a machine pertaining to the type installed in game arcades, galleries, train and bus stations, etc., offering an entertainment game, which operates by the introduction of a triggering chip and which game, in certain cases, is supplemented by external commands used by the authorized player.

Specifically, in this case the machine bases its game on granting the player the possibility to obtain, by introducing a triggering chip, one or several new chips as a prize, as a result of the game.

DESCRIPTION OF THE PRIOR ART

Machines of this indicated type are known, usually called "cascades," since they are based on the placement of gradual platforms at various levels, which platforms are kept in alternating advancing and retreating linear movements. The platforms of the prior art are crossed by vertical partitions, which partitions remain spaced apart and separated from the platforms at a lower vertical height than the vertical thickness of triggering chips laying flat on the platforms. The chip introduced by the user falls onto a platform on a first platform level, where other chips are found. The chip introduced by the aforementioned advance and retreat movement of the vertical partitions displaces the adjacent chips by pushing them, making some of them fall onto a lower step platform, which is also in movement, thus obtaining a relocation of the chips. The movement and relocation of the chips may make some of the other chips fall to the next level, and so the chips fall successively in a cascade movement down to a lower level, where there are devices for unloading and delivery of the chips won by the authorized player.

The operating principle of these prior art machines is the horizontal advance and retreat movement of the horizontal platforms, and certain shortcomings were noted, not only in the game, but also in the operational efficiency of the machine per se, especially including the fact that one chip falling on top of another chip may produce an undesirable obstruction that prevents the normal movement of the respective platform.

Due to its structure and operation, the prior art machines do not allow the installation of chip or coin recipients that select the chips preferentially, in order to avoid the introduction of foreign objects (small plates, plastic, sinkers, small washers etc.), which obstruct the system.

SUMMARY OF THE INVENTION

In contrast, the machine covered by present invention exceeds the efficacy of those currently known prior art cascade game machines, since it is based on an innovative operating principle, namely, that of structuring an innovative, attractive game for the user-player, with the advantage of practically eliminating any possibilities for undesirable obstructions of the playing surfaces.

Indeed, the machine of the present invention bases its operation on a single gyrating movement around and on a vertical axle. It presents a transparent exterior cabinet, so as to make it possible to clearly see all movements and actions taking place in the interior of the machine.

In operation, the authorized player introduces the chip from an upper level, in order to have it fall onto a first horizontal plate, where it superposes itself and is mixed with other chips, which are already there, and which are distributed thereon. Brushes of a special design sweep a circular track on the first horizontal plate, during which the brushes may displace some of the chips found there, making the chips fall from the rim of the first horizontal plate to another similar plate, located on a lower plane. The latter chips, when falling onto the second plate, cause a rearrangement of the chips found there, so as to trigger a new sweeping of the circular track, possibly causing new chips to fall from the rim to another plate, located lower than the previous ones. Thus, successively, chips are displaced towards the lowest level, where collecting devices place the chips where they may possibly be extracted by the user.

After so defining the basic operation of the machine, the structure of the machine is made up of a vertical command axle which gyrates around itself, which axle is preferably contiguous with the symmetry axis of the machine, and which vertical axle is operated by an electrical motor located in the lower part. The gyrating axle extends up within the borders of the upper end of the machine. The gyrating axle holds the aforementioned sweeping brush elements solidly, in the most convenient configuration. The sweeping brush elements move in the aforementioned gyrating circular movement, in order to sweep the horizontal plates where the chips fall.

In turn, the axle crosses and intersects the geometric centers of several plates located on various levels. The plates are preferably discoidal, and are spaced apart and are not contiguous with the axle, but are supported and mounted on the frame, so that they do not gyrate. It is a condition of the present invention and of the game that the discoidal plates have increasing diameters from the top down, so as to assure that a chip falling from a higher platform is stopped on the immediately lower level.

The simplicity of the rotating movement, as well as its basic structure assures a permanent, stable operation, with no possibility for undesirable obstruction. There are no frictions and, on the other hand, the machine allows adding various additional attractions to the game, which attractions may operate based on the same gyrating movement, such as the incorporation of holes in the various platforms, through which the chips can fall, without the need for the chips to reach the rim, as well as various devices which, using the gyrating movement, cause delivery of the chips which reach the lower level.

DESCRIPTION OF THE DRAWINGS

To specify the advantages thus summarily explained, to which users and specialists in the field may add many more, and in order to facilitate understanding of the construction, components and operational features of the present invention, it is described below a preferred example of its operation, which is illustrated schematically, without reference to a specific determined scale, in the enclosed drawing figures. It is expressly clarified that, precisely because the following is an example, it is not intended to give any limitations or exclusive features, to the scope of protection of the present invention, but is simply intended as an explanation or illustration of the basic concept on which the machine is based, according to the following drawings in which.

DETAILED DESCRIPTION OF THE PREFERRED EMBODIMENT

Figure 1:
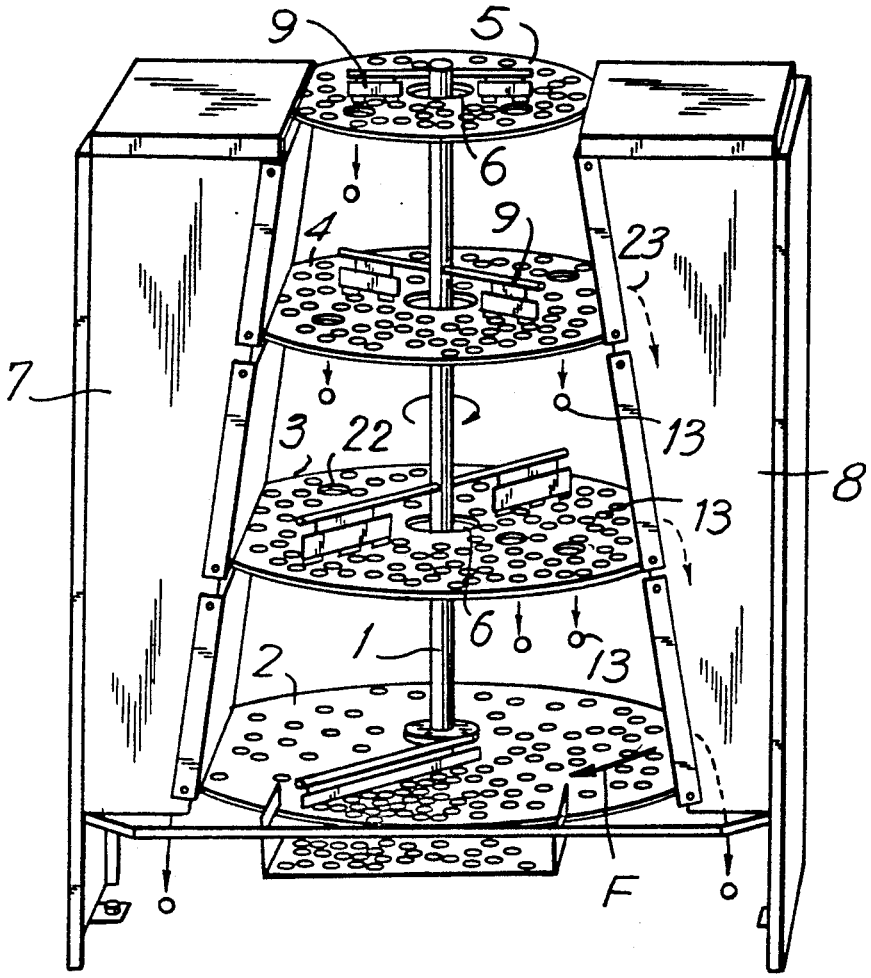
FIG. 1 is a perspective view of the basic structural parts making up a gyrating machine for an entertainment game, such as is in the present invention.

In the drawings FIGS. 1, 1A, 2 and 2A, the same reference number indicates the same or equivalent part, or element, making up the ensemble of the present invention, according to an example selected to explain the gyrating machine of the present invention.

As can be seen from the drawing FIGS. 1, 1A, 2 and 2A, the gyrating machine for an entertainment games referred to as the present invention includes a vertical gyrating axle -1-, which gyrating axle -1- is coupled with an electric motor (not illustrated), which may be preferably located in the lower part of the machine, including an appropriate speed reducer, in order to cause a relatively slow and continuous gyrating movement shown by the arrow depicted as -F-.

In the preferred embodiment, the axle -1- crosses and intersects each of a plurality of discoidal platforms -2-, -3-, -4-, and -5-, through their respective geometric centers, with the particularity that, in this case, the lower portion -2- is contiguous solid with the gyrating axle -i-, such that gyrating axle -1- and lower platform -2- gyrate together in the same direction -F-, while the other discoidal platforms -3-, -4-, -5- have respective central aperture holes with larger diameters than the axle -1-. At their respective horizontal levels, these platforms -3-, -4-, -5- are supported by the hollow column frame supports -7- and -8-, such that platforms -3-, -4-, and -5- remain fixed and stable in a strictly horizontal positions adjacent to and contiguous with hollow column frame supports -7- and -8-.

On the other hand, on the same axle -1- the hanging sweepers -9- are mounted, spaced apart from and across from the upper surfaces of the aforementioned fixed platform plates -3-, -4- and -5-. In this case two hanging sweepers -9- are used for each platform -3- or -4-, disposed across from each other.

Obviously, starting from the aforementioned arrangement of the hanging sweepers -9-, there are many possible structural constructions for obtaining the indicated function, all such constructions being equivalent. In the preferred embodiment, as shown in the drawing, FIGS. 1, 1A, 2 and 2A, there is illustrated each sweeper -9- which sweeper -9-, extends from a rigid rod -10-, such as that shown in the enlarged detail in FIG. 1A, contiguous and solid with the axle -1-. Thin iron strips or straps -11- hang from sweeper -9-, and which strips or straps -11-, preferably for the game, may include small similar brushes -12-, preferably made of rubber, integral with and conveniently distributed spaced apart and across from the upper surface of the respective fixed platform plates -3-, -4-, -5-.

Figure 1A:
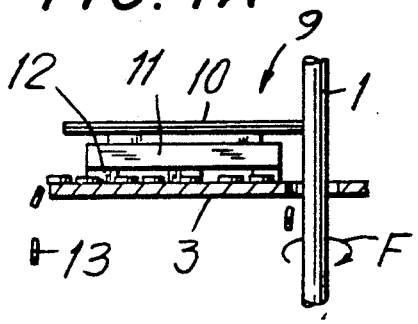
FIG. 1A is a close-up detail of the gyrating sweeper portion of the gyrating machine for an entertainment games, as shown in FIG. 1.

From an examination of the aforementioned enlarged detail shown in FIG. 1A, it can be understood that the strips or straps -11- are sufficiently heavy and rigid to drag the chips located in their gyrating course. Strips or straps -11- are capable of avoiding possible plugging or obstructions that may occur as a consequence of a possible offset in the horizontal position of the platform, or the irregular and undesirable superposition of the chips -13-. In the case illustrated, the brushes -12- are distributed preferably in groups of three per sweeper, with intervals between them which are larger than the diameter of a chip.

Figure 2:
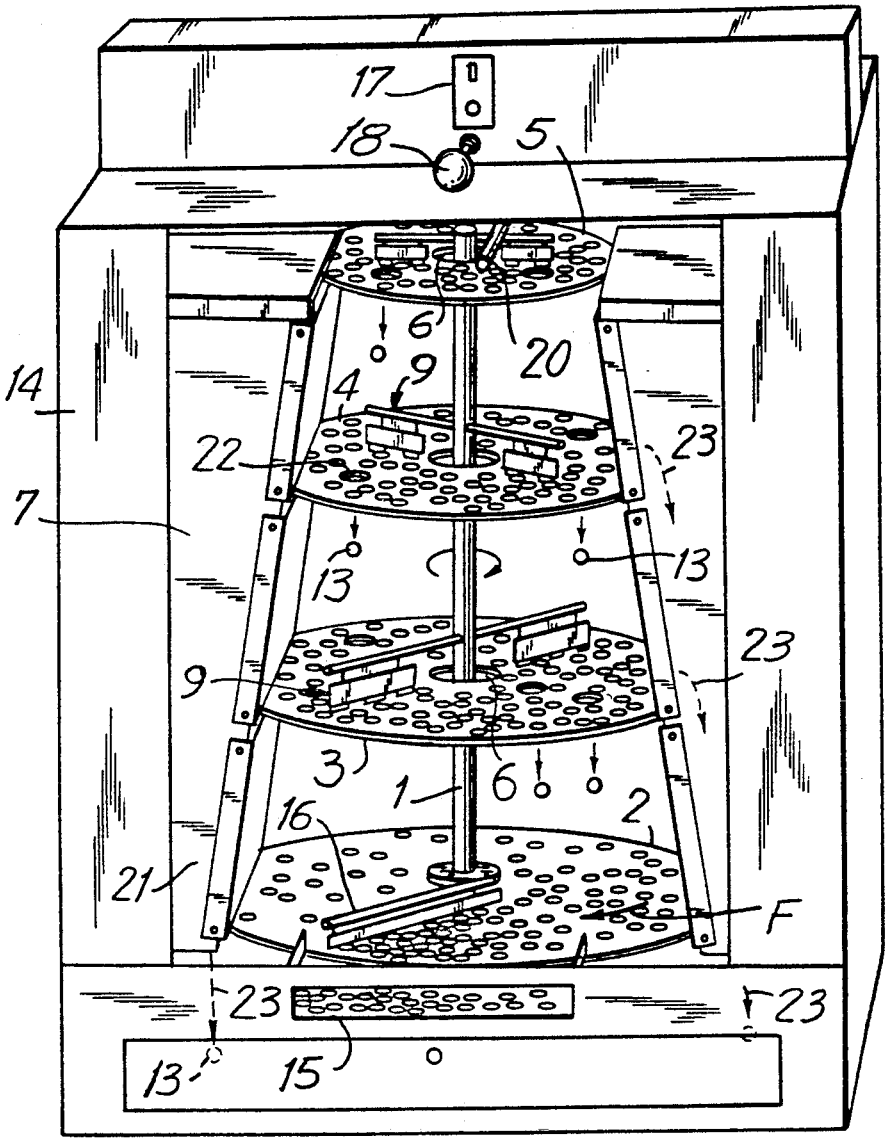
FIG. 2 is an alternate perspective view, of the gyrating machine as in FIG. 1, showing the gyrating machine with an external cabinet.

As shown in FIG. 2, it can be seen that the gyrating machine shown in FIGS. 1 and 1A is located inside a cabinet -14-, which maintains the gyrating machine totally isolated, like a protective frame, without any contact between the machine and the cabinet. This assures that unscrupulous users cannot, by hitting the machine, cause rearrangements that would make the chips fall.

According to the preferred embodiment, in the lower part of exterior cabinet -14- there is provided an outlet -15- which delivers the chips won, and which, by its internal area at the lower gyrating platform -2-, acts as a device for chip unloading and delivery, by joint action with the rotating sweeping bar -16-, located in the upper part of cabinet -14-, where the chip selector and/or screener device -17- is located, of the type which typically starts up the machine by using the passage of one or several chips with a pre-established shape. There is also provided a manual command -18-, allowing an authorized player to choose an area where he or she wants to unload the chips which he or she introduces into the machine, whereby the ability and visual reflex maneuvering of the player allows choosing the area with the highest accumulation of reposing chips on the first level, so that the player's newly introduced chip may displace the largest quantity of chips possible, by pushing them.

Figure 2A:
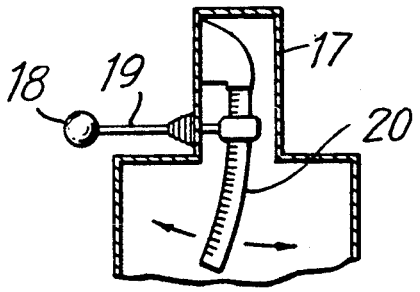
FIG. 2A is a close-up detail of the chip introducing portion of the gyrating machine for an entertainment game, for triggering the game.

As shown in FIG. 2A, there is shown a manual command, including of a rod -19- which, at its internal end, joins a flexible conduit -20-, which flexible conduit -20- guides the fall of the newly introduced chip, allowing the user to choose the area where he must deposit his chip, as explained above.

Preferably, the cabinet -14- has totally transparent external surfaces -21-, so that the user and observer can clearly see the game during all of its stages.

Referring again to the fixed platforms -3-, -4- and -5-, which platforms -3-, -4-, -5- are parallel to each other, it is noted that the present invention is not limited to this number of platforms, but may have more or less such platforms, depending on the size of the machine or the needs of the game. It is a prerequisite condition of the present invention that the respective diameters of platforms be increasing, i.e. the upper platform -5- has a smaller diameter than the middle one -4-; the latter platform -4- is smaller than -platform -3-, and the latter platform -3- is smaller than platform -2-. In turn, as an option, additional holes -22- could be introduced through the platforms, with the holes -22- having larger diameters than the chips, thereby increasing the user-player's chances of success.

The structural ensemble of the present invention being so constituted, it is clear that, when the user introduces the triggering chip into the chip selector -17-, the axle -1- is triggered into movement, and the lower discoidal platform -2- and sweepers -9- move together with it. At the same time, since the player uses the manual command knob -18-, he or she will guide the fall of a coin or chip through the flexible conduit -20-, trying to place the coin or chip in an area where, by the sweeping action of the automatic sweeper, the other chips will be displaced towards the rim of the discoidal platform -5-, where they can fall onto the platform -4-, or where the same sweeping movement causes displacements of the coin or chips towards the holes -22- or even towards the central holes -6-, thus causing the fall of the chips to a lower level.

If the same objective is achieved on platforms -4- and -3-, certain chips will be deposited on the lower gyrating platform -2-, and they will all be unloaded towards the lower outlet -15-, since the rod -16- will guide them in that direction. There may be chips falling from the platform to the interior of the hollow columns -8-, as indicated by reference numeral -23-, these being chips which the user does not win, and which are recovered by the machine.

From these explanations it clearly is shown that the operation of the present invention is based on the gyrating movement thus explained, with the possibility for many other embodiments equivalent to those illustrated, for the various functions performed by the machine.

Therefore many modifications may be made to the present invention, without departing f rom the spirit and scope of the present invention, as noted in the appended claims.

I claim:

1. A gyrating machine for an entertainment game, of a type including a cabinet which contains in its interior the machine proper, and which said machine is operated by the introduction of an authorized chip, which starts the game, comprising:

said machine being located inside the cabinet, said machine including a vertical gyrating axle, which said axle supports, at different heights a plurality of sweeping elements, each said sweeping element being located respectively across from an upper surface of each of a plurality of corresponding fixed discoidal platforms, said fixed discoidal platforms being supported by lateral columns; each said platform having a smaller diameter than the following lower platform, whereby a first upper platform of said plurality of fixed discoidal platforms constitutes a surface which receives the chip falling towards an interior of the machine when the game starts.

2. The gyrating machine according to claim 1, wherein each said discoidal platform includes a central orifice, said vertical axle crossing and intersecting said discoidal platforms through a respective central orifice of each said discoidal platform, each said central orifice having a larger diameter than said vertical axle.

3. The gyrating machine according to claim 1, wherein said discoidal platforms each have holes with larger diameters than corresponding diameters of authorized chips.

4. The gyrating machine according to claim 1, wherein said gyrating sweeping elements hang suspended from a rod integral with said vertical axle, said sweeping elements being spaced apart from each of said platforms at a vertical height less than a vertical height of a chip resting flat upon each of said platforms.

5. The gyrating machine according to claim 1, further comprising a movable lower platform which gyrates with said vertical axle.

* * * * *